US005765264A

United States Patent [19]

Ciok

[11] Patent Number: 5,765,264

[45] Date of Patent: Jun. 16, 1998

[54] BAG CLOSURE

[76] Inventor: Ray Ciok, 12A Acorn Trail, Oakridge, N.J. 07438

[21] Appl. No.: 813,904

[22] Filed: Mar. 7, 1997

[51] Int. Cl.[6] ..... B65D 33/06

[52] U.S. Cl. ..... 24/30.5 R; 24/537; 383/69; 383/906

[58] Field of Search ..... 383/68, 69, 906; 24/30.5 R, 503, 515, 536, 537

[56] References Cited

U.S. PATENT DOCUMENTS

| | | | |
|---|---|---|---|
| 2,003,704 | 6/1935 | Wenzell | 383/69 X |
| 4,979,668 | 12/1990 | Allen et al. | 383/69 X |
| 5,349,724 | 9/1994 | Bracco Barcina et al. | 24/537 X |
| 5,507,431 | 4/1996 | Bertone | 24/30.5 R X |

FOREIGN PATENT DOCUMENTS

| | | | |
|---|---|---|---|
| 3801192 | 7/1989 | Germany | 383/69 |

*Primary Examiner*—James R. Brittain
*Attorney, Agent, or Firm*—Bernard J. Murphy

[57] ABSTRACT

A pair of confronting limbs, which have mutually meshing jaws, clasp the open top of a bag therebetween when a grooved bar slides upon the limbs. The limbs have external rails, and the bar has trackways formed therein to receive the rails slidably therein. The limbs are integral with a twice-folded panel which defines a pouring spout for the subject bag of a portion of the panel; this pouring spout portion is set within the bag.

4 Claims, 2 Drawing Sheets

FIG. 2
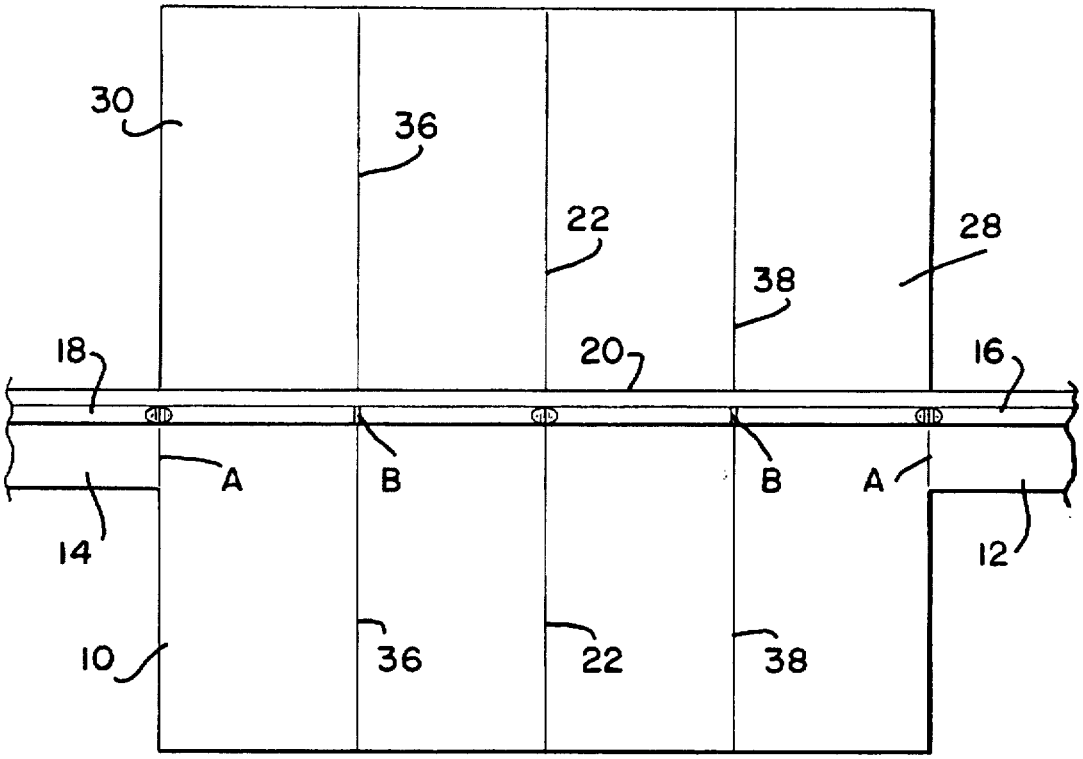
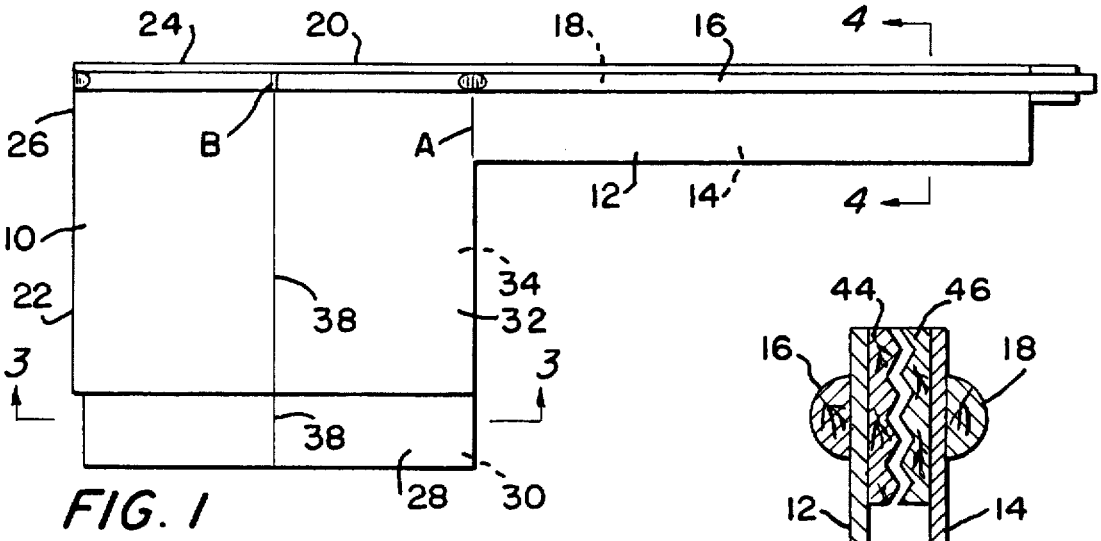
FIG. 1
FIG. 3
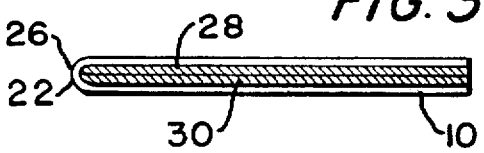
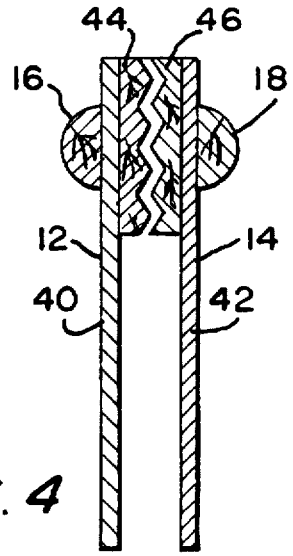
FIG. 4

BAG CLOSURE

This invention pertains to closures for bags or sacks of materials, such as bags of seed, grain, animal feed, fertilizers, garden products, industrial products, and the like, of ponderous dimensions and, accordingly, which are unwieldy and clumsy to handle.

Large sacks or bags of materials, especially granular materials, in weights up to fifty-pound plus measures, or so, stand in need of an efficient and simple closure which, after the bag has been opened, can be emplaced on the bag opening (a) to facilitate the handling of the bag, and (b) to provide for a controlled pouring out of the contents.

It is an object of this invention to set forth just such a long sought bag closure. Specifically, it is an object of this invention to disclose a navel bag closure comprising first means, operative for clasping and closing off a bag opening; and second means, for (a) releasably engaging, and (b) concomitantly operating said first means.

Further objects of this invention, as well as the novel features thereof, will become apparent by reference to the following description, taken in conjunction with the accompanying figures, in which:

FIG. 1 is a side elevational view of the jaw-faced limbs and integral panel;

FIG. 2 is an illustration of only fragments of the two limbs, with the integral panel fully opened out and showing the fold lines and planes thereof;

FIG. 3 is a cross-sectional view, taken along section 3—3 of FIG. 1;

FIG. 4 is a cross-sectional view, considerably enlarged, taken along section 4—4 of FIG. 1;

Figure 5:
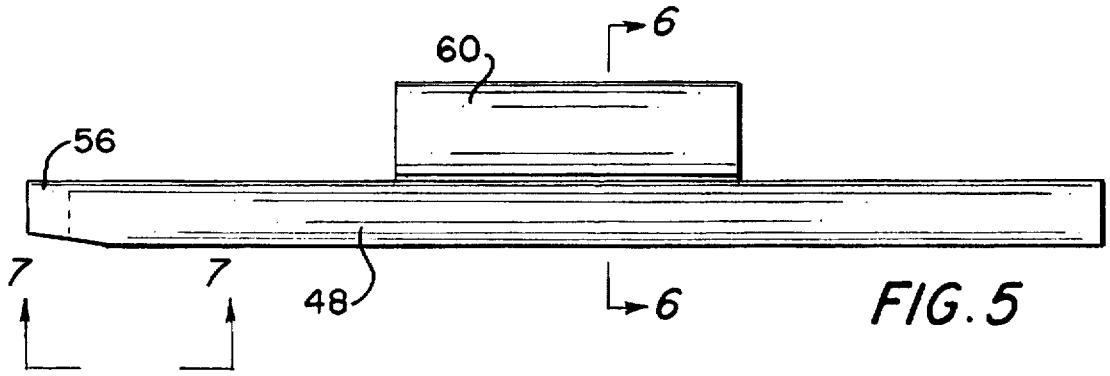
FIG. 5 is a side view of the grooved bar, with its integral handle.

As shown in FIG. 1, is a folded panel 10 the same being integral with a pair of limbs 12 and 14 which have external, elongate rails 16 and 18. The panel 10, unfolded, and opened out in FIG. 2, comprises a first, horizontal fold line 20 about which the panel is folded, and a second, vertical fold line 22 about which the panel is folded, to define the panel as shown in FIG. 1. Thus folded, line 20 becomes a first horizontal plane 24 of the panel, and line 22 becomes a second, vertical plane 26 of the panel. The limbs 12 and 14, for being integral with the panel 10, expand into the outermost portions of the panel 10. The innermost portions 28 and 30 of the folded panel 10 are provided for entry into the to-be-closed bag to serve as a pouring spout for the bag. Consequently, the open top of a bag is slidably received between the innermost portions 28 and 30, that is the pouring spout component, of the panel 10, and the outermost portions 32 and 34. Innermost portions 28 and 30, then, comprise an inner, folded skirt for entry into an open top, end portion of the to-be-closed bag, and outermost portions 32 and 34 comprise an outer, folded skirt for enclosing, therewithin, the open top, end portion of the to-be-closed bag in which the portions 28 and 30 are received. Inner skirt portions 28 and 30, then, and outer skirt portions 32 and 34, are provided to sandwich an open top, end portion of the to-be-closed bag therebetween.

Where the rails 16 and 18 bridge between the narrow limbs 12 and 14, and the expansion thereof into the panel portions 32 and 34, they are interrupted. This is so that there can be an articulation between the limbs 12 and 14, and the panel 10, at locations "A". Further, the rails 16 and 18, across the panel portions 32 and 34, are also interrupted, at "B", so that the pouring spout component of the panel 10 can be expanded outwardly. In vertical alignment with the rail interruptions at "B" are fold lines 36 and 38, the same are provided to give the panel articulation along third vertical planes which are defined by the lines 36 and 38, whereby the pouring, spout can be expanded.

The cross-section depicted in FIG. 4 shows that the limbs 12 and 14 comprise rigid arms 40 and 42 which have mutually meshing jaws 44 and 46 on the confronting faces thereof. It can be appreciated that, upon the jaws 44 and 46, which extend fully lengthwise of the arms 40 and 42, closing toward each other with a bag opening therebetween, the jaws will close off and securely clasp the bag opening.

Figure 7:
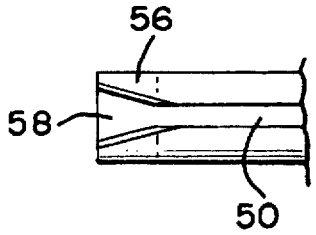
FIG. 7 is a bottom view, of the entry end of the bar, taken along 7—7 of FIG. 5.
Figure 6:
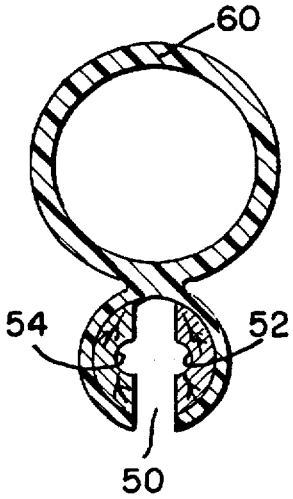
FIG. 6 is an enlarged cross-sectional view, taken along section 6—6 of FIG. 5.

The invention comprehends means for operating the arms 40 and 42 in clasp of a bag opening, the same being an elongate bar 48 shown in FIGS. 5–7. The bar 48 is channeled, having a groove 50 formed therein. In addition, the groove 50, in mutually-facing sides thereof, has mutually-confronting arcuate reliefs 52 and 54 formed therein. The reliefs 52 and 54 constitute trackways for slidable engagement thereof with the rails 16 and 18. Upon the bar 48 being slid onto the rails 16 and 18, the jaws 44 and 46 close onto each other and clasp any interposed bag opening securely therebetween. Now, it can be appreciated that the bar 48 can be slid lengthwise of the rails 16 and 18, away from the panel 10, to permit the pouring spout component thereof, that is portions 28 and 30 of the panel 10, to be freed up and expanded outwardly to facilitate pouring of any bag contents. After the desired amount of bag contents have been discharged from the bag, the bar 48 can be slid across the rails 16 and 18 which are across the panel 10, to seal off the pouring spout.

To render a facile entry of the rails 16 and 18 into the bar 48, the entry end 56 of the bar has a mouth-widened configuration 58 of the groove 50. The bar 48 has fixed integrally thereto a handle 60 for the carrying of a closed bag therewith.

In the instant embodiment, the panel 10 and the arms 40 and 42 are formed of firm cardboard, the rails 16 and 18 comprise half-round doweling, and the elongate jaws 44 and 46 are formed of wooden stock. The bar 48 is of plastic composition, and has parallel wooden inserts in which the reliefs 52 and 54 are formed, and the handle 60 is of plastic stock as well. Now, these constructional details are simply arbitrary. The panel 10, arms 40 and 42, the rails 16 and 18 and jaws 44 and 46 could all constitute a one-piece plastic molding, if desired. Too, the bar 48 need not have wooden inserts; the bar itself could be formed with integral and arcuately relieved walls in its groove. Also, the cylindrical, plastic handle 60 clearly could be supplanted by other handle configurations and of differing material fastened to the bar 48. Accordingly, while I have described my invention in connection with a specific embodiment thereof, it is to be clearly understood that this is done only by way of example, and not as a limitation to the scope of the invention as set forth in the objects thereof and in the appended claims.

I claim:

1. A bag closure, comprising:

first means, operative for clasping and closing off a bag opening; and second means, for (a) releasably engaging, and (b) concomitantly operating said first means; wherein said first means comprises a pair of parallel limbs which have mutually confronting faces;

said faces comprise mutually meshing jaws;

said limbs comprise elongate rails;

said second means comprises a channel-shaped element having trackways formed therein for slidably engaging said rails by said trackways; and said first means further comprises a folded panel, interposed between said rails, for engaging a bag opening, and comprising (a) an inner folded skirt for entry into an open top, end portion of a to-be-closed bag, and (b) an outer folded skirt for enclosing therewithin said open top, end portion of a to-be-closed bag; wherein said skirts comprise means for (a) sandwiching therebetween such an open top, end portion of a to-be-closed bag, and (b) defining a pouring spout.

2. A bag closure, according to claim 1, wherein:

said element comprises an elongate bar;

said bar has a groove formed therein and extending substantially the full length of said bar; and said trackways comprise mutually-confronting, arcuate reliefs formed in mutually-facing sides of said groove.

3. A bag closure, according to claim 1, further including:

a handle coupled to said second means.

4. A bag closure, according to claim 1, wherein:

said panel is folded, as afore-said, along a first, horizontal plane, and folded along a second, vertical plane;

said panel is articulatory along third, vertical planes;

said third, vertical planes are astride said second, vertical planes; and said rails are interrupted whereat they align with said third, vertical planes, to render said rails articulatory thereat with said panel.

* * * * *